United States Patent [19]

Penrice et al.

[11] Patent Number: 4,762,559

[45] Date of Patent: Aug. 9, 1988

[54] HIGH DENSITY TUNGSTEN-NICKEL-IRON-COBALT ALLOYS HAVING IMPROVED HARDNESS AND METHOD FOR MAKING SAME

[75] Inventors: Thomas W. Penrice, Mt. Juliet; James Bost, Murfreesboro, both of Tenn.

[73] Assignee: Teledyne Industries, Incorporated, Los Angeles, Calif.

[21] Appl. No.: 79,428

[22] Filed: Jul. 30, 1987

[51] Int. Cl.[4] ..... C22C 27/04

[52] U.S. Cl. ..... 75/248; 75/246; 419/28; 419/29; 419/32; 419/38; 419/39; 419/54; 419/55; 419/58

[58] Field of Search ..... 75/246, 248; 419/28, 419/29, 32, 38, 39, 54, 55, 58

[56] References Cited

U.S. PATENT DOCUMENTS

| | | | |
|---|---|---|---|
| 3,888,636 | 6/1975 | Sczerzemie et al. | 75/248 |
| 3,979,209 | 9/1976 | Snyder | 75/248 |
| 3,979,239 | 9/1976 | Northcutt et al. | 419/28 |
| 3,988,118 | 10/1976 | Grierson et al. | 419/29 |

*Primary Examiner*—Stephen J. Lechert, Jr.

*Attorney, Agent, or Firm*—Beveridge, DeGrandi & Weilacher

[57] ABSTRACT

A tungsten-nickel-iron-cobalt high density alloy having unexpected improved strength and hardness properties and the method of making such alloy are disclosed. The alloy has from about 85–98% by weight tungsten with the remainder being a nickel-iron-cobalt binder in which the cobalt is present in amounts of from at least about 5% up to 47.5% by weight of the binder and the amount of cobalt being equal to or less than the amount of nickel. After the powders of the elements in the indicated amounts are homogeneously blended, compacted into a shape and sintered, the sintered shape is subjected to a heat treatment in a flowing argon atmosphere for a period of time and at a temperature at least sufficiently high to solubilize the intermetallic or $\mu$ phase, $Co_7W_6$, formed at the matrix to tungsten interface during cooling from the sintering temperature, and to diffuse into the gamma austenitic phase, thus leaving the alpha tungsten/gamma austenite boundaries substantially or essentially free of such intermetallic or $\mu$ phase. The alloy is subsequently subjected to a swaging step resulting in a reduction in area of from 5 to 40% and then may be aged for about an hour within the range of about 300°–600° C.

29 Claims, 5 Drawing Sheets

Samples were swaged 25% and aged 1 hr. at elevated temperature

HIGH DENSITY TUNGSTEN-NICKEL-IRON-COBALT ALLOYS HAVING IMPROVED HARDNESS AND METHOD FOR MAKING SAME

The present invention relates to an improved high density tungsten-nickel-iron-cobalt alloy having unexpectedly improved hardness and tensile strength properties and to a method for making such alloy.

BACKGROUND OF THE INVENTION

While the high density, high melting point and strength of tungsten alloys make them a good candidate material for use in kinetic energy penetrators and other high stress applications, there has been a need for improved performance of tungsten alloys for use in such applications. Commercially pure tungsten is relatively brittle but it is known in the art that alloying tungsten with nickel-copper or nickel-iron binders can produce two phase alloys with useful strength and ductility for these applications. It is also known that the composition ratio of alloying additions to tungsten must be kept within a range that avoids formation of intermetallic compounds which causes embrittlement in the alloy. For example, in the commercially important tungsten-nickel-iron alloy system the nickel to iron ratio is generally held within the range of about 1:1 to 4:1. Outside this range, brittle, intermetallic phases form in the binder phase which rapidly degrade the properties.

The propensity of the iron and nickel alloys to form an intermetallic phase is well known in the art. At low nickel to iron ratios the intermetallic $Fe_7W_6$ is known to form as a $\mu$ phase. Above the ratio of about 4:1 nickel to iron, a series of Ni:W intermetallics can form, including $Ni_2W$, NiW and $Ni_4W$. Heat treatments can be used to effectively break down such intermetallics since they are not stable at temperatures above 1000° C. Quenching from a solutionizing temperature of about 1050° C. can retain the ductile austenitic binder or matrix in the two phase system.

At the iron rich end of the alloy composition, the $\mu$ phase, $Fe_7W_6$, is stable to a temperature of about 1640° C., which is above the normal temperature range for sintering these alloys. The $\mu$ phase can only be controlled by diffusion into the austenite within a narrow temperature range corresponding to a limited tungsten solubility.

It has been well established that the tendency to the formation of the topologically close packed $\mu$ (mu) or sigma phases or intermetallics can be determined by calculating an electron vacancy number, $N_v$, for a given composition of the alloys. For instance, the $N_v$ of the heavy alloy binder is related to the chemistry of the binder by the following equation:

$$N_v = \frac{0.66 \times \%\,Ni + 1.66 \times \%\,Co + 2.66 \times \%\,Fe + 4.66 \times \%\,W}{100}$$

where %Ni, %Co, %Fe and %W refer to their concentrations in the binder phase expressed in atomic %. The multiplicity factor assigned to each element (such as 0.66, 1.66, . . . etc.) indicates the propensity of the element to the formation of the intermetallic phase. If the $N_v$ value for a given binder composition exceeds a critical value C* (the actual value of C* is dependent on the amount of tungsten in solution, temperature and a constant for the particular alloy system), then the binder is susceptible to the formation of intermetallic phases. If the Nv value of the binder alloy is less than C*, then it is free from intermetallic formation.

Based on the above criterion, it is clear that elements which have a higher multiplicity factor would be more prone to the formation of the intermetallic phase compared to an element which has a lower multiplicity factor. For instance, nickel has the lower value (0.66) and, therefore has the least propensity to intermetallic formation compared to iron (2.66) or tungsten (4.66). Substitution of cobalt (1.66) for nickel would tend to raise the $N_v$ value and make the alloy more susceptible. Therefore, it would not be expected that replacement of nickel by cobalt decreases the formation of intermetallics and, therefore, improves the mechanical properties of the resulting alloys. While it is known that cobalt additions to the tungsten-nickel-iron system increase strength and hardness, as the amount of cobalt is increased embrittlement of the sintered alloy is also increased. Furthermore, when such cobalt-containing sintered alloys, and particularly those containing large amounts of cobalt in the binder are subsequently subjected to an annealing treatment, embrittlement of the material occurs, making it virtually useless for its intended purpose in high stress applications, such as kinetic energy penetrators.

Thus U.S. Pat. No. 2,793,951 discloses a powder metallurgical process for producing dense tungsten alloys wherein the main constituent consists of tungsten and/or molybdenum and a minor constituent consisting of one or more of the metals iron, nickel, cobalt, chromium with the proportion of the main constituent being not less than 75% by weight of the alloy. The alloys are made by sintering compacted mixtures of the metal powders in the requisite proportions. The inclusion of chromium in the alloy results in improving the hardness of the alloy.

U.S. Pat. No. 3,254,995 discloses heavy metal alloys having relatively high tungsten content and having high density, high tensile strength and high elongation properties, wherein the core of the alloy has substantially as good properties as the outside surfaces. Such properties are enhanced due to the use of iron in substantially equal or greater proportion than the nickel. The addition of small amounts of cobalt to the tungsten-iron-nickel alloy increases the sintering temperature range and stabilizes the part during sintering. It is stated that the cobalt additions do not impair the properties and may even slightly enhance them. Cobalt may be used effectively in amounts up to 1% of the total weight of the alloy. While higher amounts of cobalt may be used, for most applications about 1% or less has been found adequate. The alloys are produced by sintering in a hydrogen atmosphere and then cooled.

U.S. Pat. No. 3,988,118 discloses tungsten alloys containing minor amounts of nickel, iron and molybdenum and at least one additional element which either increases the mechanical properties at room temperature, including strength, ductility and/or increases the corrosion resistance and resistance to oxidation at elevated temperatures and/or increases the resistance to thermal fatigue. These additions include cobalt, chromium, manganese, vanadium, tantalum, zirconium, titanium, yttrium, rhenium, boron and silicon. Cobalt is said to inhibit the formation of undesirable intermediate compounds, such as tungsten and nickel, and should be used in the range of about 0.5 to 5% by weight percent. Heat treating the sintered compact in a neutral or slightly reducing atmosphere and then quenching rapidly produces elongations of from 5 to 25% in the treated alloy.

U.S. Pat. No. 4,012,230 discloses a tungsten-nickel-cobalt alloy and a method for making such alloy wherein tungsten particles are coated with a nickel-cobalt alloy, compacted to shape, heated in hydrogen to 1200° to 1400° C. for one hour and cooled to about 1200° C. The hydrogen atmosphere is then replaced by argon and the shaped sintered compact is held at that 1200° C. temperature for one half hour and is then cooled to room temperature in the argon atmosphere. The patent states that considerable hardness occurs in these alloys at lower sintering temperature. The alloys show high strengths and can have good ductilities. Use of two percent cobalt in the alloy is disclosed.

It is known in the art that the strength and hardness of tungsten-nickel-iron alloys can be increased by imparting some degree of work to such alloys. For example, swaging a sintered bar by a reduction in cross-sectional area of 25% can increase the hardness of a 93% W-4.9% Ni-2.1% Fe tungsten alloy from 30 points on the Rockwell C scale of hardness to about 38–40 points. It is also a known characteristic of these alloy systems that they strain age readily at modest temperatures after introduction of pre-strain by working.

In a paper entitled "Studies of Tungsten Heavy Metals" by G. Jangg, R. Keiffer, B. Childeric and E. Ertl appearing in *Planseeberichte fur Pulvermetallurgie* 22 (1974), 15–28, the authors disclose that a small cobalt addition to tungsten heavy metal alloys containing nickel and iron has a positive effect on ductility and hardness of the alloy when compacts of such alloys are sintered. The values of density, hardness and torsional fracture angle are a function of the sintering temperature and sintering time with such temperature being 1460° C. and the time being about 60 minutes for a 90.8 W-5.5 Ni-2.8 Co-1.9 Fe alloy. The article states that hardness is more greatly affected by variation of binder composition and concludes that toughness and hardness of the alloy are not affected in entirely the same way and that a favorable combination of good hardness values with a high torsional angle can be chieved with a binder composition of 50 to 55% Ni, 25 to 30% Co and 20% Fe. While the authors disclose that in the as-sintered condition, the W-Ni-Fe-Co alloys are superior to the conventional W-Ni-Fe alloys, they do not teach how such as-sintered properties can be further improved.

In a paper entitled "*Effects of Cobalt on Nickel-Tungsten Alloys,*" by F. F. Schmidt, D. N. Williams and H. R. Ogden, Cobalt, 45, December 1969, at pages 171–176, inclusive, the effect of cobalt on the mechanical and metallurgical properties of nickel-tungsten alloys wherein the alloys contained 45 or 50 percent tungsten is discussed. However, the tungsten-nickel-cobalt alloys which were formed are single phase austenites in which all of the individual ingredients have been dissolved to form the alloys. The systems disclosed in this paper are entirely different from the high density system of the present invention.

SUMMARY OF THE INVENTION

It has been found that the cause of embrittlement resulting from the use of increased amounts of cobalt in the tungsten-nickel-iron-cobalt high density alloys is due to the formation of a precipitated intermetallic or $\mu$ phase having the composition $Co_7W_6$. It has further been found that by subjecting the alloy to a specific heat treatment procedure such intermetallic, $Co_7W_6$, is removed, leaving a two phase alloy containing higher cobalt contents than have been heretofore practicable for ductile alloys, and having unexpectedly higher strengths and hardness. It has been found that in order to achieve the unexpected improved properties of tensile strength and hardness in the alloy when subjected to the process of the invention, the amount of cobalt in the binder should be from at least about 5% to 47.5% by weight of the binder phase, and, preferably, about 12% to 47.5% by weight of the binder phase.

Elemental powders of tungsten, nickel, iron and cobalt are initially blended and then compacted under high pressure to form a bar. The resulting compacted bar is heated in a hydrogen atmosphere to a temperature within the range of 1460°–1590° C. for about 30–60 minutes. The sintered bar is then heated in an atmosphere of flowing argon gas to a high temperature of about 1200°–1400° for about one to three hours during which time the residual hydrogen contained in the sintered bar is diffused out and carried away by the flowing argon gas. During this heating stage the temperature is sufficient to enable the $\mu$ phase or intermetallic which formed at the matrix to tungsten interface during cooling from the sintered temperature to diffuse into the $\gamma$ austenitic phase, leaving the $\alpha$ tungsten/$\gamma$ austenite boundaries substantially or essentially free of the $\mu$ phase. This desired material state is preserved by quenching the heat treated compact in oil, water or brine. The bar is then swaged with a reduction in area of about 5% to 35% and, typically, 25%. The resulting alloy has unexpectedly improved tensile strength and hardness properties for a given measure of ductility. In the preferred embodiment of the invention, the tensile strength and hardness of the high density alloy can be further increased by aging the alloy at a temperature of about 300°–600° C. for about an hour.

DETAILED DESCRIPTION OF THE INVENTION

Figure 1:
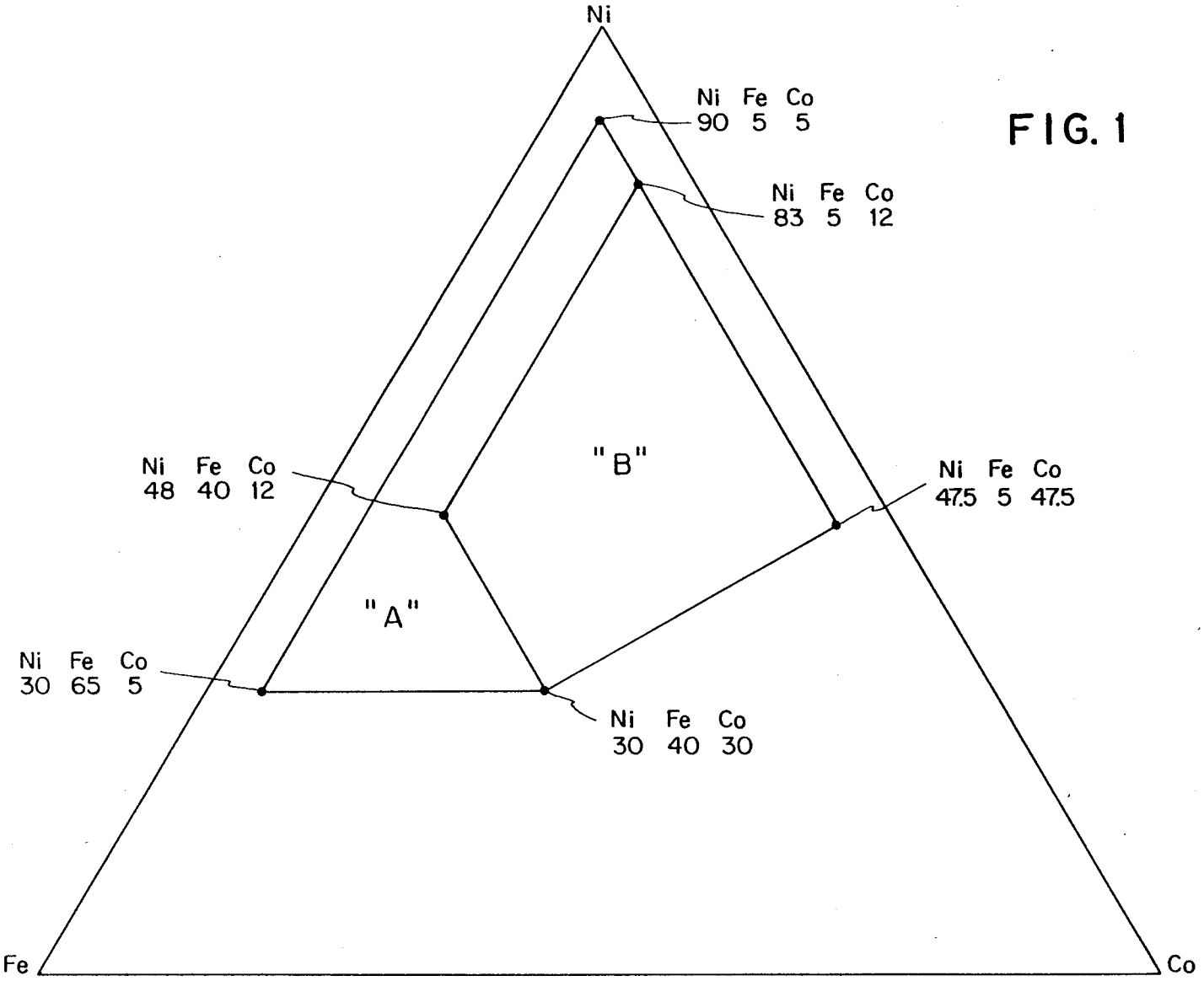
FIG. 1 is a ternary diagram illustrating the binder composition of nickel, iron and cobalt, both useful and preferred, for making the heavy density tungsten-nickel-iron-cobalt alloys of the invention.

The high density alloys of the invention contain about 85 to 98 and preferably from about 90 to 97 weight percent tungsten with the balance of the alloy being essentially nickel, iron and cobalt in the compositional range coming within area "A" of the ternary diagram illustrated in FIG. 1 and, preferably, coming within the area "B" located within area "A" of such diagram.

Nickel, iron and cobalt dissolve tungsten when heated to their melting points. While the solubility varies for each element and reduces significantly upon cooling, such solubility is typically in the range of 10–25 weight percent of tungsten retained in solution for the practicable range of nickel/iron/cobalt composition. Nickel shows the highest solubility and cobalt the lowest.

In general, the present invention comprises the steps of blending powders of tungsten, nickel, iron and cobalt into homogeneous compositions wherein the tungsten is present in an amount of about 85 to 98 percent, and preferably about 90 to 97 percent, by weight and the binder powders of nickel, iron and cobalt are present in amounts falling within area "A" of the ternary diagram of FIG. 1 and preferably within area "B" of such ternary diagram. It is essential that the cobalt be at least about 5% to 47.5% and, preferably, about 12% to 47.5% by weight of the binder phase of the alloy in order to obtain the improved properties of the invention. The concentration ranges for the alloying elements in the binder phase are about 30 to 90 percent nickel, 5–65% iron and 5–47.5% cobalt with the amount of cobalt being at least equal to or less than the nickel content of the binder phase.

Thus an alloy of 90% tungsten will contain 3–9 percent nickel, 0.5–6.5 percent iron and 0.5–4.75 percent cobalt, by weight, and preferably will contain about 3–8.3% nickel, 0.5–4% iron and 1.2–4.75 percent cobalt, by weight. An alloy in which tungsten is present in an amount of 97 percent by weight will contain about 0.9–2.7 percent nickel, 0.15–1.95 percent iron and 0.15–1.425 percent cobalt, by weight, and preferably will contain about 0.9–2.49 percent nickel, 0.15–1.2 percent iron and 0.36–1.425% cobalt, by weight. Compacted slugs or bars of such powders are prepared using a pressure of about 10–15 tons per square inch, without the addition of a temporary binder or lubricant. The slugs or bars are then placed on fused alumina grit in ceramic or molybdenum boats and heated in a hydrogen atmosphere to a temperature in the range of 1460° C. to about 1590° C., which temperature is sufficient to liquify the nickel, iron, cobalt and tungsten in solution, for a time of from about 30 to about 60 minutes.

After cooling, the bars are heated in an atmosphere of flowing argon gas to a temperature in a range of 1100°–1500° C., and preferably, about 1200° to about 1400° C. for a period of about 1–3 hours, which conditions are sufficient to enable the intermetallic phase, i.e. the $\mu$ phase (which formed at the matrix to tungsten interface during cooling from the sinter temperature) to diffuse into the $\gamma$ austenitic phase leaving the $\alpha$ tungsten/$\gamma$ austenite boundaries substantially or essentially free of $\mu$ phase or intermetallics. Furthermore, a substantial proportion of the residual hydrogen contained in the sintered bar is diffused out and carried away in the argon gas atmosphere.

The annealed bar with its desired material state is preserved by quenching it in oil, water or brine. Such quenching results in the bar being cooled to room temperature at a rate exceeding about 5° C. per second, and, preferably, exceeding about 25° C. per second. Unless the bar is rapidly cooled in this manner, the desired improved mechanical properties are not achieved. The bar is subsequently swaged with a reduction in area of about 5 to 40% and, typically, 20–25% and then may be aged at a temperature of about 300° to 500° C. for about an hour if additional improvement in properties is desired. The resulting alloys have unexpectedly improved hardness properties and improved tensile strength properties while essentially retaining their ductility and are suitable for high stress applications, such as kinetic energy penetrators having improved ballistic performance.

It is appreciated that if the alloy material to be swaged is first warmed to about 300° C. in order to facilitate the swaging process, for example, if the heavy duty swaging equipment usually recommended is not available, it is possible to swage and age the alloy simultaneously, resulting in a high density, i.e. about 17 to about 18.5, having the improved hardness and tensile strength while maintaining suitable ductility to be worked into, for example, kinetic energy penetrators.

The following examples are illustrative of the improved high density tungsten-nickel-iron-cobalt alloys and of the method for producing such alloys.

EXAMPLE 1

An alloy, used as a control for comparison with alloys of the invention, was prepared from powders of tungsten, nickel and iron which were homogeneously blended, shaped into a bar having the composition 93% tungsten, 4.9% nickel and 2.1% iron and subjected to a pressure of 15 tons/in$^2$. The compacted bar was placed on fused alumina grit in a ceramic boat and heated in a hydrogen atmosphere to a temperature of 1525° C. for a period of 30 minutes and then allowed to cool to room temperature. The bar was tested and found to have a hardness of 30 Rockwell C, an ultimate tensile strength (UTS) of 133,000 psi and an elongation property of 16%.

The sintered bar was annealed in vacuum for 10 hours at 1050° C. at a residual atmosphere pressure of about 0.01/mm of mercury. After cooling to room temperature and then tested, the hardness property of the bar was unchanged. However, the ultimate tensile strength had increased to 134,500 psi and the elongation property had increased to 28%.

The bar was then heat treated in an atmosphere of flowing argon gas at a temperature of 1100° C. for one hour and then quenched in water. Upon testing, the hardness of the material was unchanged, the ultimate tensile strength was now 135,000 psi and the elongation was 31%. The bar was then swaged with a reduction in area of 25%. Upon testing, the hardness was Rockwell C 39, tensile strength was 165,000 psi and elongation was 10%.

A part of the bar was then aged at 300° C. for 1 hour and another part of the bar was aged at 500° C. for 1 hour. The properties noted, together with the foregoing properties, are set forth in Table 1.

TABLE 1

| Material Condition | Ultimate Tension Stress* | % Elongation at Fracture** | Hardness Rockwell C |
|---|---|---|---|
| As-sintered | 133,000 | 16 | 30 |
| Plus Vacuum Anneal | 134,500 | 28 | 30 |
| Plus Vacuum Anneal Plus Argon and Quench | 135,000 | 31 | 30 |
| Plus Swaged 25% Reduction | 165,000 | 10 | 39 |
| Plus aged at 300° C./1 hr | 175,000 | 7.8 | 41.7 |
| Plus aged at 500° C./1 rs | 182,500 | 4.7 | 43.5 |

*Pounds per square inch (psi)
**Length to diameter ratio of 4:1 (ASTM E8) Crosshead speed 0.003 inch/minute While tensile strength and hardness continued to improve after aging, the percent elongation valve considerably decreased.

EXAMPLE 2

The process steps of Example 1 were repeated with a high density alloy in which the alloy composition was 93% tungsten, 2.1% cobalt, 3.43% nickel and 1.47% iron. This composition represented a 30% substitution of the amount of binder of Example 1 with cobalt, i.e., 30% of the nickel and 30% of the iron were substituted by cobalt with the nickel to iron (Ni:Fe) ratio being maintained as 7:3 in both alloys of Examples 1 and 2.

The alloy mixture of Example 2 was processed and tested in identical fashion to the alloy of Example 1 and the following properties were determined.

TABLE 2

| Material Condition | Ultimate Tension Stress* | % Elongation At Fracture** | Hardness Rockwell C |
|---|---|---|---|
| As-sintered | 138,000 | 22.4% | 31 |
| Plus Vacuum Anneal | 65,000 | 0.5% | 37 |
| Plus Vacuum Anneal Plus Argon and Quench | 0 | 0 | 37 |

*Pounds per square inch (psi)
**Length to diameter ratio of 4:1 (ASTM E8) Crosshead speed 0.003 inch/minute The deterioration of properties of the alloy containing cobalt upon being subject to annealing is evident. The result is what would be expected by one skilled in the art, knowing of the presence of a large amount of cobalt in the binder. The alloy, when annealed and quenched in the manner described in Example 1, becomes so embrittled that it is totally unsuitable for its intended application.

EXAMPLE 3

A sintered bar having the composition of the bar of Example 2 and prepared in accordance with the process of Example 2 and subjected to the identical process conditions, except that instead of first subjecting it to a heat treatment of 1050° C. for ten hours in vacuum, it was heated in a flowing argon atmosphere at a temperature of 1350° C. for two hours and then immediately quenched in water. The bar was evaluated for stress, elongation and hardness properties and then was processed through identical swaging and aging steps as described in Example 1, with the following results being obtained.

TABLE 3

| Material Condition | Ultimate Tension Stress* | % Elongation At Fracture** | Hardness Rockwell C |
|---|---|---|---|
| As-sintered | 138,000 | 22.4% | 31 |
| Quenched After 2 hours at 1350° C. | 143,000 | 33.8% | 32 |
| Plus Swaging to 25% Reduction | 180,000 | 13.0% | 43 |
| Swage Plus Age 300° C./1 hour | 187,000 | 11.0% | 44.5 |
| Swage Plus Age 500° C./1 hour | 210,800 | 8.0% | 47.5 |

*Pounds per square inch (psi)
**Length to diameter ratio of 4:1 (ASTM E8) Crosshead speed 0.003 inch/minute As is evident from Example 3, when the solutionizing of the intermetallics takes place at the annealing temperature of 1350° C., together with the removal of hydrogen from the bar by the argon gas, the increased strength caused by the presence of the cobalt is evident. Comparison of the swaged data demonstrates the unexpected properties associated with cobalt additions in the alloy. The Rockwell C hardness of 43, 44.5 and 47.5 obtained in the high density alloys in Table 3 corresponds to a VHN hardness of about 480, 490 and 565, respectively, which is almost about double the hardness obtained by the prior art. The VHN or Vickers hardness is expressed in terms of kilograms per square millimeter.

A Rockwell C hardness of 43 obtained by the composition of Example 3 after being swaged to 25% reduction is a very significant hardness for the high density alloy and makes it unexpectedly superior for use in high stress applications, such as kinetic energy penetrators, particularly since the ductility of the alloy is satisfactory for making such penetrators. Such hardness and tensile strength can additionally be increased by aging the alloy after swaging at a temperature of about 300°-600° C. for about one hour without greatly reducing the alloy's ductility. In comparing the tensile and hardness properties of the cobalt containing alloy of Example 3 with that of the control alloy of Example 1 containing no cobalt, the properties set forth in Table 3 are totally unexpected and clearly superior. Thus one can further fabricate the alloy to produce improved kinetic energy penetrators.

Figure 3:
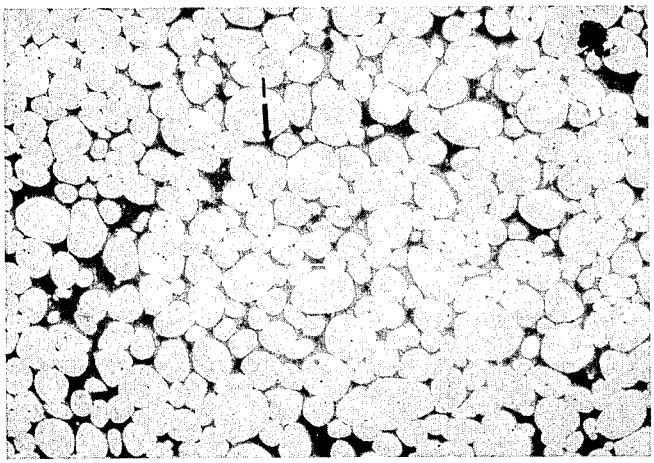
FIG. 3 is a photomicrograph of the heavy tungsten alloy of the invention taken at 220× magnification.

From the photomicrograph of FIG. 3, the structure of the heavy alloy of Example 3, which was subjected to the annealing treatment at 1350° C. and then quenched, consists of spherical tungsten grains and ductile binder phase. The intermetallic phase is absent and the alloy is strong and ductile.

Figure 2:
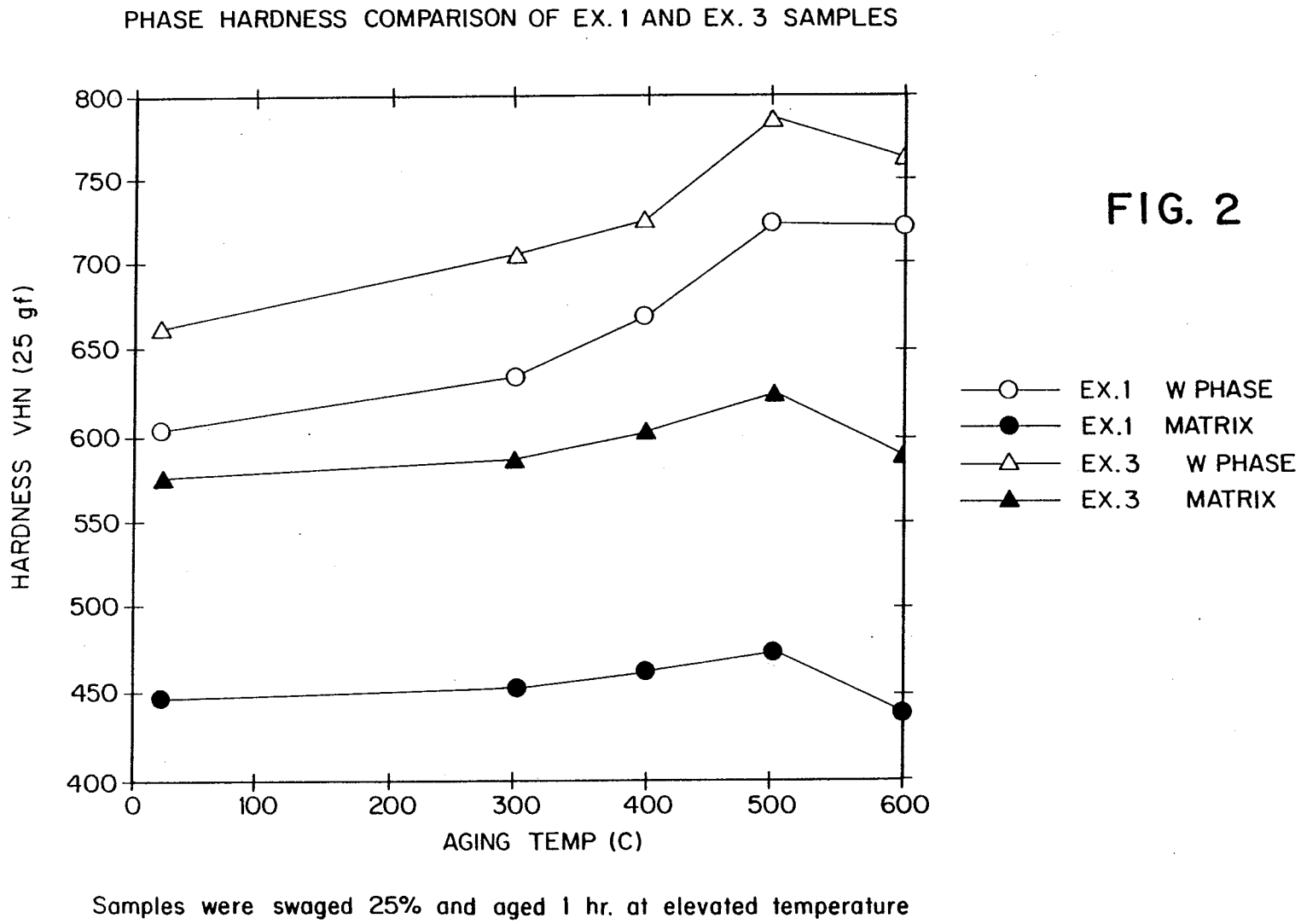
FIG. 2 is a graph illustrating the hardness properties of the tungsten phase and tungsten matrix of an alloy of the invention after being subjected to aging as compared to a control alloy.

FIG. 2 illustrates the VHN hardness of the tungsten and matrix of the alloys made in accordance with the process described above for Examples 1 and 3. Each alloy was swaged to 25% reduction in area and then aged for one hour at the temperature indicated in FIG. 2. The strength increase in the matrix is a consequence of the enhanced work hardening after swaging because of the lower stacking fault energy of cobalt.

The increase in the hardness of the tungsten phase from a Vickers diamond microhardness measured at a 25 gram load of 603 to 661 D.P.N. was totally unexpected. This finding is most important because the tungsten phase represents the largest volume fraction of the alloy in the range of tungsten contents of importance in high stress applications, such as kinetic energy penetrators.

Figure 4:
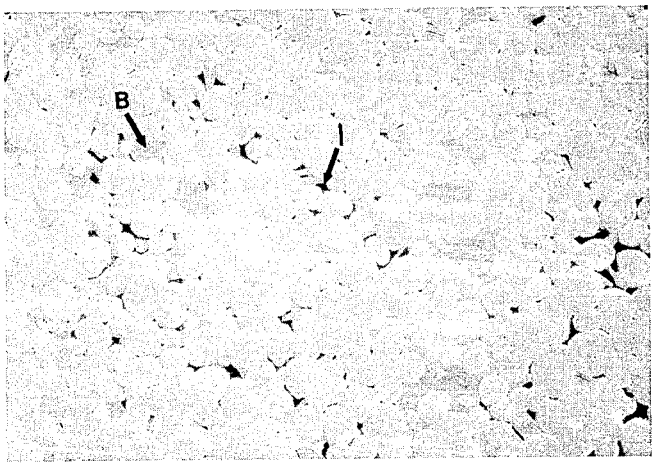
FIG. 4 is a photomicrograph of a heavy tungsten alloy having an excessive amount of cobalt taken at 200× magnification.

The photomicrograph of FIG. 4 shows the poor results obtained when the cobalt is present in an amount of 50% by weight of the binder. The heavy tungsten alloy has the composition 93% tungsten, 2.45% nickel, 1.05% iron and 3.5% cobalt, by weight, and the alloy was subjected to the same treatment as the heavy tungsten alloy of Example 3, including annealing at 1350° C. for two hours. It is readily evident from FIG. 4 that the alloy structure consists of spherical tungsten grains and significant amounts of an intermetallic phase, marked B. The ductile binder phase is marked I and the alloy was extremely brittle.

Figure 5:
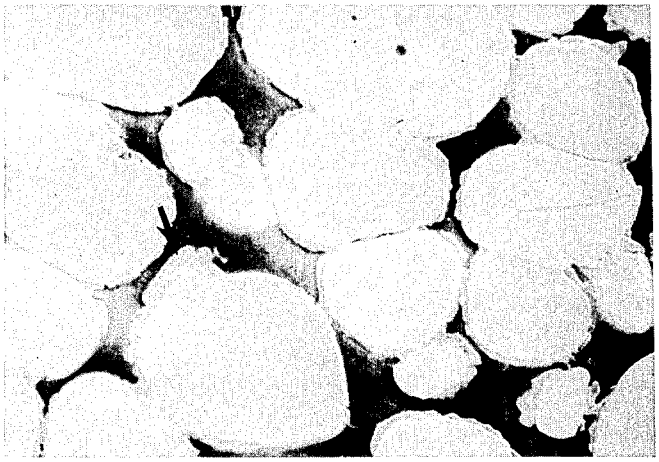
FIG. 5 is a photomicrograph of a heavy tungsten alloy having the composition of the FIG. 3 alloy but subject to a different annealing treatment and taken at a 1300× magnification.

The heavy tungsten alloy shown in the photomicrograph of FIG. 5, although having the same composition as the alloy of Example 3, was vacuum annealed at 1050° C. for ten hours, i.e. the standard processing used in the art. The alloy exhibited poor properties. The brittle phase is present at the binder/tungsten interface and is indicated by arrow.

Figure 6:
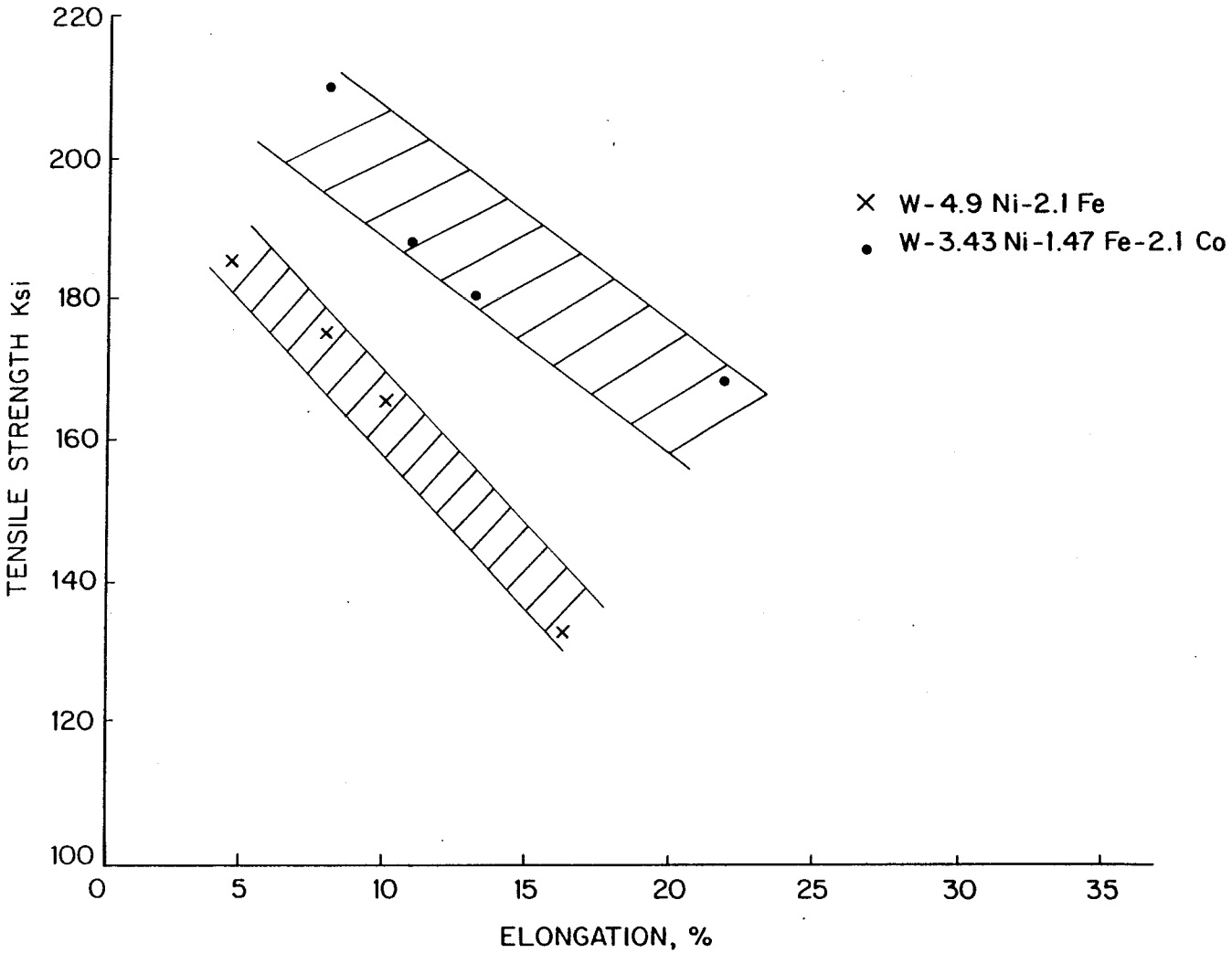
FIG. 6 is a graph showing strength-ductility comparison of the heavy tungsten alloys at different stages in the processing.
Figure 7:
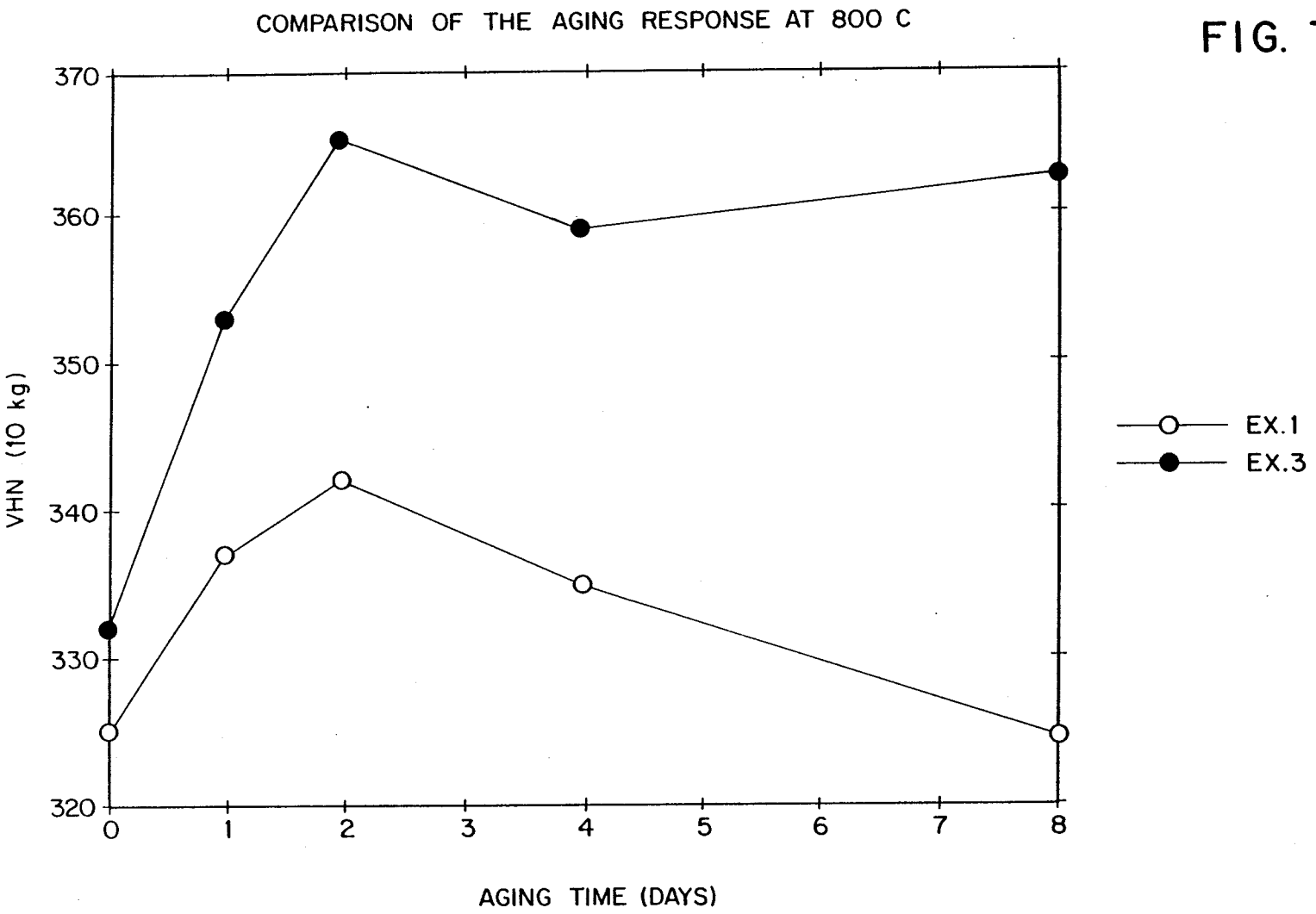
FIG. 7 is a graph illustrating the effect of an aging treatment over several days on the hardness of an as-sintered alloy of the invention compared to an as-sintered control alloy.

The strength versus ductility properties of the heavy tungsten alloys of Example 1 without cobalt in the binder and Table 3 with cobalt in the binder, wherein the latter is annealed in accordance with the invention, are plotted in the graph of FIG. 6 from the data in Tables 1 and 3 at different stages of the processing. The cobalt-containing high density alloys of the invention show superior strength-ductility properties.

While flowing argon gas is preferred in annealing the alloy in accordance with the invention, it will be evident that other protective gaseous atmospheres which are substantially free from hydrogen, such as helium, nitrogen, etc., can be used.

It has been further noted that sintered alloys of the compositions set forth in Examples 1 and 3, respectively, after they have been formed, as as-sintered products, and then subjected to a prolonged aging period at 800° C. of from one to eight days have their hardness properties increased to a maximum hardness after two days. Further aging results in a continual decrease in hardness properties in the control as-sintered alloy composition made in accordance with Example 1, whereas the as-sintered alloy composition made in accordance with Example 3 has its hardness decrease slightly from its peak after four days and then continually increase to substantially its peak hardness after eight days. This result in the cobalt-containing sintered alloy was totally surprising and unexpected.

What is claimed is:

1. The process of making high density alloy containing about 85 to 98 weight percent tungsten and the balance of the alloy being essentially a binder of nickel, iron and cobalt, and wherein said cobalt is present in an amount within the range of about 5 to 47.5 weight percent of said binder, comprising blending powders of said tungsten, nickel, iron and cobalt into a homogenous composition, compacting said homogenous composition into a shaped article, heating said shaped article to a temperature and for a time sufficient to sinter said article, subjecting said sintered article to a temperature sufficient to enable the intermetallic phase formed at the matrix to tungsten interface to diffuse into the gamma austenitic phase whereby the alpha tungsten/gamma austenite boundaries are essentially free of such intermetallic phase, quenching said article, and swaging the article to a reduction in area of about 5 to 40 percent, said article having improved mechanical properties, including improved tensile strength and hardness while maintaining suitable ductility for subsequent working thereof.

2. The process of making high density tungsten-nickel-iron-cobalt alloys as defined in claim 1 wherein the temperature to which said article is heated is within the range of from about 1200° to 1400° C. and said article is maintained at this temperature for a period of from about one to three hours.

3. The process of making high density tungsten-nickel-iron-cobalt alloys as defined in claims 1 or 2 including subjecting said swaged article to a temperature of about 300° to 600° C. for about an hour.

4. The process of making high density tungsten-nickel-iron-cobalt alloys as defined in claims 1 or 2 wherein said binder consists essentially of about 30 to 90 percent nickel, about 5 to 65 percent iron and about 5 to 47.5 cobalt, and wherein the amount of cobalt in the binder is equal to or less than the amount of nickel.

5. The process of making high density tungsten-nickel-iron-cobalt alloys as defined in claim 3 wherein said tungsten is present in an amount of about 90–97 weight percent of said alloy and said binder consists essentially of about 30 to 83 percent nickel, about 5 to 40 percent iron and about 12 to 47.5 percent cobalt and wherein the amount of cobalt in the binder is equal to or less than the amount of nickel.

6. A high density tungsten-nickel-iron-cobalt alloy made in accordance with the process as defined in claim 1.

7. The process of making a high density alloy containing about 85 to 98 weight percent tungsten and the balance of the alloys being essentially a binder of nickel, iron and cobalt in the compositional range coming within area "A" of the ternary diagram illustrated in FIG. 1 of the drawing and wherein the amount of cobalt is equal to or less than the amount of nickel, comprising blending powders of said tungsten, nickel, iron and cobalt into a homogenous composition, compacting said homogenous composition into a shaped article, heating said shaped article in a hydrogen atmosphere to a temperature and for a time sufficient to sinter said article, cooling said sintered article to room temperature, placing said sintered article in a flowing argon gas atmosphere while subjecting said article to a temperature sufficient to enable the intermetallic phase formed at the matrix to tungsten interface during the cooling of the sintered article to room temperature to diffuse into the gamma austenite phase whereby the alpha tungsten/gamma austenite boundaries are essentially free of such intermetallic phase, quenching said article to room temperature, and swaging said quenched article to a reduction of about 5 to 40 percent in area, said article having improved mechanical properties, including improved tensile strength and hardness, while maintaining suitable ductility for subsequent working thereof.

8. The process of making the high density alloy as defined in claim 7 wherein said binder of nickel, iron and cobalt is in the compositional range coming within area "B" of the ternary diagram illustrated in FIG. 1 of the drawing.

9. The process of making the high density alloy as defined in claim 7 wherein the tungsten is present in the alloy in an amount of about 90–97 weight percent.

10. The process of making the high density alloy as defined in claim 8 wherein the tungsten is present in the alloy in an amount of about 90–97 weight percent.

11. The high density alloy having improved mechanical properties including improved tensile strength and hardness, made in accordance with the process as defined in claim 7.

12. In the process of making high density alloys containing about 85 to 98 weight percent tungsten and the balance of the alloy being essentially a binder of nickel, iron and cobalt, comprising blending powders of said tungsten, nickel, iron and cobalt into a homogenous composition, compacting said homogenous composition into a shaped article, sintering the shaped article to form an alpha tungsten phase and a gamma austenite phase therein, and cooling said sintered article whereby an intermetallic phase $Co_7W_6$ forms at the interface of the alpha tungsten phase and the gamma austenite phase, the improvement whereby the mechanical properties of the sintered article, including tensile strength and hardness, are improved over the same properties in the sintered article comprising having said binder consisting essentially of about 30 to 90 percent nickel, about 5 to 65 percent iron and about 5 to 47.5 percent cobalt, wherein the amount of cobalt in the binder is equal to or less than the amount of nickel, placing said sintered article in a flowing argon gas atmosphere while subjecting said article to a temperature sufficient to enable said intermetallic phase formed at the interface of the alpha tungsten phase and the gamma austenite phase to diffuse into the gamma austenite phase whereby the alpha tungsten/gamma austenite boundaries are essentially free of such intermetallic phase, quenching said article to room temperature, and swaging said quenched article until it is reduced about 5 to 40 percent in area.

13. The process as defined in claim 12 wherein said composition for forming said high density alloy containing about 85 to 98 percent tungsten has the binder consisting essentially of about 30 to 83 percent nickel, about 5 to 40 percent iron and about 12 to 47.5 percent cobalt and the amount of the cobalt in the binder is equal to or less than the amount of nickel.

14. The process of making a high density alloy as defined in claim 13 wherein said alloy contains about 90–97 percent by weight tungsten and the binder of nickel, iron and cobalt comes within the compositional range coming within area "A" of the ternary diagram illustrated in FIG. 1 of the drawing.

15. The process of making the high density alloy as defined in claim 14 wherein said binder of nickel, iron and cobalt is in the compositional range coming within the area "B" of the ternary diagram illustrated in FIG. 1 of the drawing.

16. The process as defined in claims 12, 13, 14 or 15 further including the step of subjecting the swaged article to a temperature of from about 300°–500° C. for about one hour to further improve the hardness and tensile strength properties over those properties of the swaged article while maintaining the ductility of the alloy within the range of suitability for subsequent working of said alloy.

17. The tungsten-nickel-iron-cobalt high density alloy having improved hardness and strength properties made in accordance with the process as defined in claims 12, 13, 14 or 15.

18. The tungsten-nickel-iron-cobalt high density alloy as defined in claim 17 having the composition consisting essentially of about 93% tungsten, 3.4% nickel, 1.5% iron and 2.1% cobalt.

19. A high density tungsten-nickel-iron-cobalt alloy consisting essentially of, by weight, about 85 to 98 percent tungsten, about 30 to 90 percent nickel, about 5 to 65 percent iron and about 5 to 47.5 percent cobalt, the amount of said cobalt being equal to or less than the amount of nickel, said alloy having a Rockwell C hardness property of over 40, said alloy consisting essentially of an alpha tungsten phase and a gamma austenitic phase and the boundaries between said alpha tungsten and gamma austenite being essentially free of $Co_7W_6$ intermetallic.

20. The high density tungsten-nickel-iron-cobalt alloy as defined in claim 19 wherein said alloy consists essentially of about 30–83 percent nickel, 40 to 70 percent iron and about 12–47.5 percent cobalt and the amount of said cobalt is equal to or less than the amount of said nickel.

21. The high density tungsten-nickel-iron-cobalt alloy as defined in claims 19 or 20 wherein said alloy also has a tensile strength of at least 180,000 psi and a ductility suitable for working said alloy.

22. The high density tungsten-nickel-iron-cobalt alloy as defined in claim 21 wherein said alloy has a Rockwell C hardness of at least 43.

23. The high density tungsten-nickel-iron-cobalt alloy as defined in claim 21 wherein said alloy has a Rockwell C hardness of at least 47.

24. The high density tungsten-nickel-iron-cobalt alloy as defined in claim 23 wherein said alloy has a tensile strength in excess of 200,000 psi.

25. In the process of making high density sintered alloys containing about 85 to 95 weight percent tungsten and the hardness of the alloy being essentially a binder of nickel and iron, comprising blending powders of said tungsten, nickel and iron into a homogenous composition, compacting said homogenous composition. into a shaped article, sintering said shaped article to form an alpha tungsten phase and a gamma austenite phase therein, and cooling said sintered article, the improvement whereby the hardness property of said sintered article is increased to its highest level of hardness after being subjected to a temperature of about 800° C. for a period of time sufficient to attain such highest level, and such improved hardness property is substantially maintained during further heating of the sintered article at said 800° C. temperature, comprising substituting for a portion of nickel and iron powders of said binder from about 5 to 47.5 percent by weight of cobalt powder, said nickel then being present in an amount of about 30 to 90 percent and said iron being present in an amount of about 5 to 65 percent of said binder, the amount of said cobalt in said binder being equal to or less than the amount of nickel, said substitution occurring prior to said compacting step.

26. The process as defined in claim 25 wherein said cobalt is present in an amount of from 12 to 47.5 percent, said nickel is present in an amount of 30 to 83 percent and said iron is present in an amount of 5 to 40 percent, by weight of said binder, and the tungsten in said alloy is present in an amount of 90–97 percent by weight.

27. The process as defined in claims 25 and 26 wherein said time sufficient to attain said highest level of hardness in the sintered alloy is about two days.

28. The as-sintered high density tungsten-nickel-iron-cobalt alloy having improved hardness properties made in accordance with the process as defined in claim 27.

29. The as-sintered high density alloy defined in claim 28 wherein said alloy consists essentially of, by weight, about 93% tungsten, 3.4% nickel, 1.5% iron and 2.1% cobalt.

* * * * *